US006062412A

United States Patent [19]

Jacobsmeyer, Jr.

[11] Patent Number: 6,062,412

[45] Date of Patent: May 16, 2000

[54] CONTAINER COVER

[76] Inventor: Donald W. Jacobsmeyer, Jr., 1117 Timberlane Dr., St. Louis, Mo. 63122

[21] Appl. No.: 09/126,289

[22] Filed: Jul. 30, 1998

[51] Int. Cl.[7] ..... B65D 51/18

[52] U.S. Cl. ..... 220/254; 220/287; 220/315; 220/908; 150/154; 383/43

[58] Field of Search ..... 220/254, 287, 220/315, 908; 150/154, 159; 383/43

[56] References Cited

U.S. PATENT DOCUMENTS

| | | | |
|---|---|---|---|
| 1,090,565 | 3/1914 | Port | 220/287 X |
| 1,330,345 | 2/1920 | Randolph | 220/287 X |
| 3,977,451 | 8/1976 | Duba | 150/159 X |
| 4,043,368 | 8/1977 | Forte, Sr. | 220/375 X |
| 5,131,442 | 7/1992 | Bevier | 150/159 |
| 5,390,717 | 2/1995 | Schenker et al. | 150/159 |
| 5,490,594 | 2/1996 | Rupe | 150/159 X |
| 5,560,485 | 10/1996 | O'Hara, Jr. | 150/159 X |
| 5,676,247 | 10/1997 | Shioda | 150/159 X |
| 5,709,312 | 1/1998 | Lake | 220/287 |
| 5,718,353 | 2/1998 | Kanfer et al. | 220/254 X |
| 5,904,247 | 5/1999 | Voelkner, Jr. | 150/159 X |

*Primary Examiner*—Stephen K. Cronin
*Attorney, Agent, or Firm*—Polster, Lieder, Woodruff, & Lucchesi, L.C.

[57] ABSTRACT

A container cover (10) for use with different types of containers (C) such as garbage cans and storage receptacles. The cover includes a waterproof, stretchable material (12) fitting over the mouth (M) of the container, regardless of the size and shape of the mouth. The cover is sufficiently long so as to extend beneath handles (H) on the side of the container. Fasteners (20) are provided to secure the base (28) of the cover to the side (S) of the container, the cover having notches (22) for the container's handles to be easily grasped by someone wanting to lift or move the container. The portion of the cover extending over the mouth of the container includes an openable closure (30) which allows the user to place objects in the container when the closure is opened, and to keep them from being spilled or gotten at when the closure is closed.

11 Claims, 2 Drawing Sheets

CONTAINER COVER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to containers such as garbage cans and the like, and more particularly, to a cover for such containers which can fit containers of different sizes and shapes and which can be used to replace damaged, lost, or stolen lids for such containers.

It is not uncommon for the lid of a container such as a garbage can to be lost, damaged, or stolen. In such instances, while the garbage can is still usable, anything dumped into the container can now more easily be spilled, or gotten at by rodents and other vermin. Replacement lids for such containers are not a commodity item such that the lid can easily be replaced. Rather, a new trash can must be bought which is essentially a needless expense since only a new lid is what is needed.

Other containers are sold without a lid at all. However, depending upon the usage to which the container is put, it may oftentimes be desirable to have a cover for the container. It would be advantageous therefore to have a readily installable cover that can be conveniently used when it is desired to cover the container.

Finally, containers come in different sizes and shapes. Regardless of the containers size or shape, it would also be advantageous to have a cover which is adjustable to fit over containers of many different constructions so that only one cover is needed for a wide variety of applications.

BRIEF SUMMARY OF THE INVENTION

Among the several objects of the present invention may be noted the provision of a container cover for use on garbage cans and other receptacles and containers to replace the lid normally provided with such containers;

the provision of such a container cover to be used either to replace lost, damaged, or stolen covers for such containers, or as a cover for containers not normally having one;

the provision of such a container cover usable with containers having different shaped mouths, for example, round or rectangular mouths;

the provision of such a container cover to be of a pliable, stretchable material which readily fits over the mouth of a container;

the provision of such a container cover to extend beneath the height of the container handles and to be tightly secured about the container at the lower extent of the cover so as not to come off if the container inadvertently tips over, the cover having openings leaving the handles exposed for grasping of the container by the user;

the provision of such a container cover to be of a weather resistant material so to prevent rain, dirt, dust, and debris for getting into the container;

the provision of such a container cover, when closed, to prevent birds, rodents, and other vermin from getting at the contents of the container, the cover material being strong enough to resist being attacked by these animals, as well as to not tear when the container is turned over or on its side, thereby preventing spillage of the container contents;

the provision of such a container cover to be available in a variety of colors, whereby a user can use covers of one color for containers holding one thing, and covers of a different color for containers holding other things;

the provision of such a container cover to also be available in different color patterns; and, the provision of such a container which is low cost, easily cleaned after use, and readily stored when not in use.

In accordance with the invention, generally stated, a container cover is for use with different types of containers; for example, garbage cans and storage receptacles. The cover includes a waterproof, stretchable material which fits over the mouth of the container, generally regardless of the size and shape of the mouth. The cover is sufficiently long so as to extend beneath the handles on the side of the container. Fasteners are provided to secure the base of the cover to the sides of the container, the cover having openings for the container's handles to be easily grasped by someone moving the container. The portion of the cover extending over the mouth of the container includes an openable closure which allows the user to place things in the container when the closure is opened, and to keep them from being spilled or gotten at when the closure is closed. Other objects and features will be in part apparent and in part pointed out hereinafter.

BRIEF DESCRIPTION OF THE SEVERAL VIEWS OF THE DRAWINGS

In the drawings.

FIGS. 5A and 5B illustrate installation of the container cover over a garbage can or the like;

Corresponding reference characters indicate corresponding parts throughout the drawings.

DETAILED DESCRIPTION OF THE INVENTION

Figure 1:
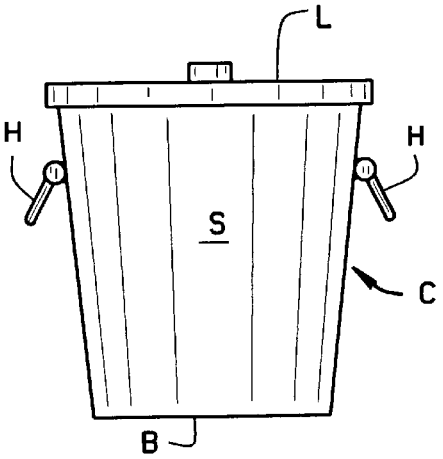
FIG. 1 PRIOR ART
FIG. 1 is a representation of a prior art container having a lid.
Figure 2A:
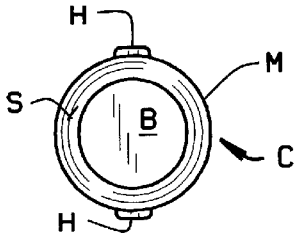
FIG. 2A PRIOR ART
FIGS. 2A and 2B illustrate representative mouth configurations for conventional containers.
Figure 2B:
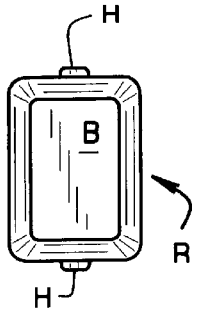
FIG. 2B PRIOR ART
Figure 8:
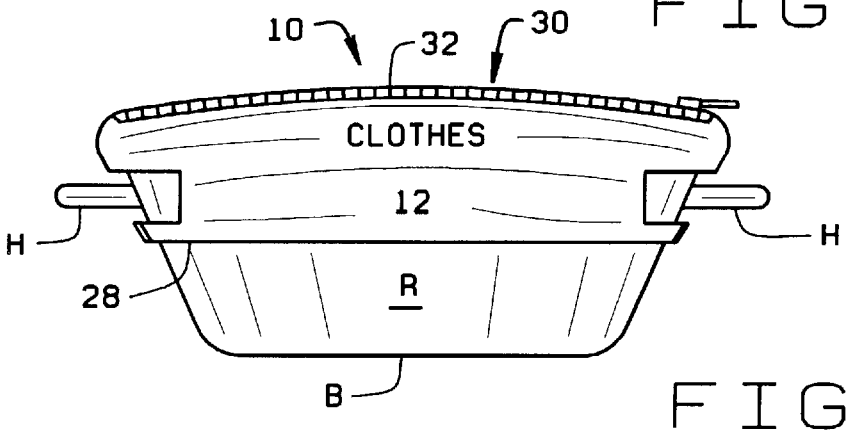

Referring to the drawings, a container C is shown in FIG. 1 to have a tapering cylindrical shape, the mouth M of the container being larger in diameter than the base B thereof. The container, for example, a garbage can or the like, has a pair of opposed handles H. A lid L, provided with the container, fits over its mouth end to enclose whatever is put into the container. Other containers such as the receptacle R shown in FIGS. 2B and 8, are shallower in construction and have a generally rectangular shaped mouth as opposed to the circular shaped mouth of container C. Typically, these containers are not sold or provided with lids. Over time, the lids L of containers C tend to be damaged, if not lost or stolen, so that the contents of the container are subject to spillage. Or, if left outdoors, vermin, rodents, or other animals can get into the container and scatter its contents. Since many containers C are used as garbage can, clean-up becomes a messy problem, not mention the possible health hazards created. With respect to the receptacles R, it is sometimes desirable to have a closure or lid for the receptacle to protect whatever is stored in it.

Figure 4:
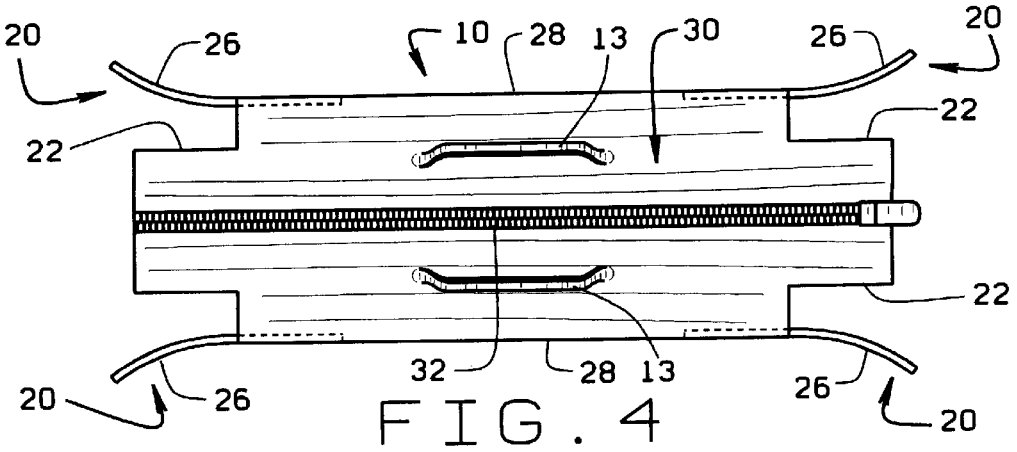
FIG. 4 is a top plan view of the container cover.
Figure 5A:
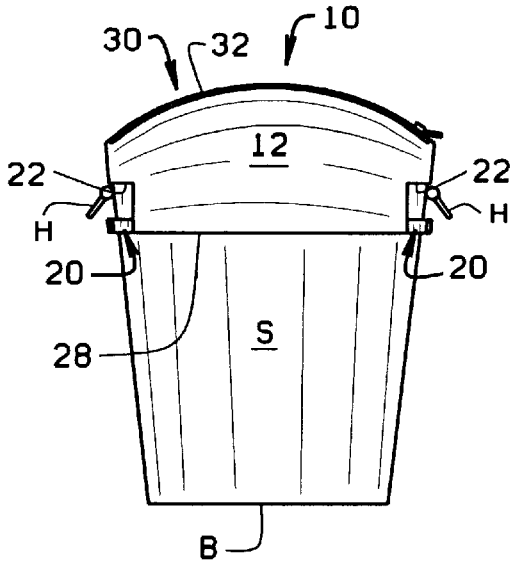
Figure 5B:
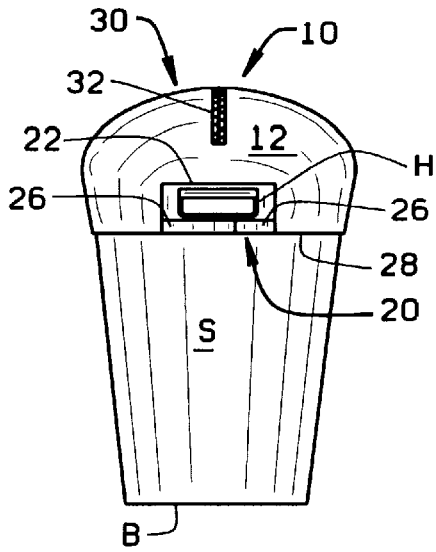

A container cover 10 of the present invention is provided as a replacement for the lid L used with container C, as well as a closure for the receptacle. Cover 10 comprises a flexible material 12 which, as shown in FIG. 4, is cut in a generally rectangular pattern. It is a feature of the invention that the cover is sized so as to be usable both with containers C and receptacles R. That is, the same cover can be used both with round mouth and rectangular mouth containers since the. Besides being sized to fit over the mouth of a container or receptacle, the material is further sized so as to extend down a sidewall S of the container a distance below the top of the container. This is as shown in FIGS. 5A, 5B, and 8. Since, as noted, the container has handles for lifting and moving the container, the length of fabric 12 is such that cover 10 extends down the sidewall of the container the level of the handles. Or, the cover has attached handles 13.

Material 12 can be a number of different type fabrics. If the container cover is used outdoors, then the fabric is preferably a waterproof fabric and is also resistant to clawing and chewing by animals so to keep the animals from getting through the material and at the contents of the container. If used outdoors, with garbage or other refuse containers, then the fabric is also preferably washable. For storage purposes, where more than one cover is used, it is helpful that the cover is available in different colors and patterns. This allows the user to identify what is stored in a container. Different legends can also be imprinted on the fabric for this purpose. Thus as shown in FIG. 8, the word CLOTHES printed on the cover helps identify the contents of receptacle R.

Figure 3:
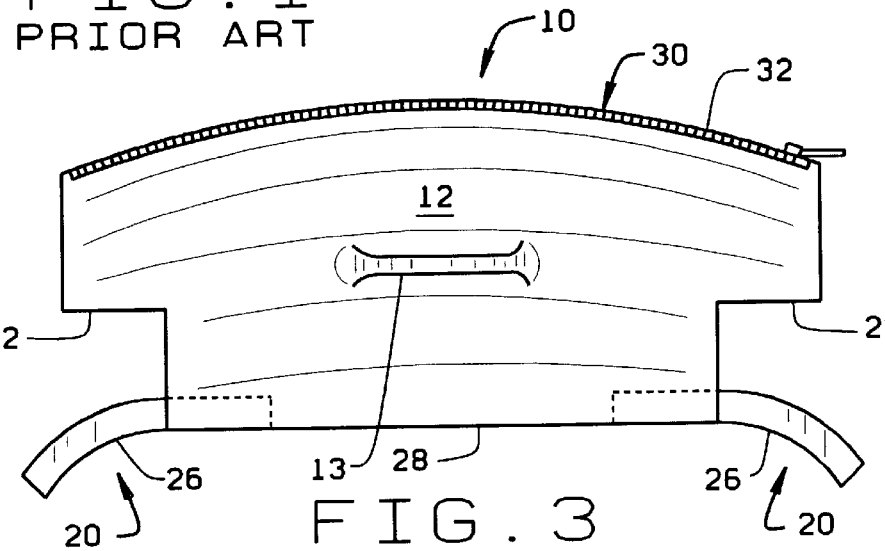
FIG. 3 is an elevational view of a container cover of the present invention.
Figure 6A:
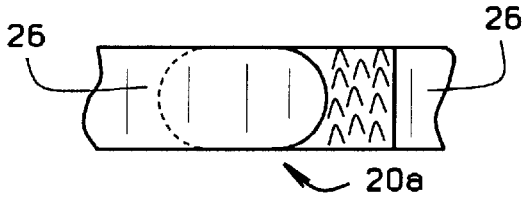
FIGS. 6A–6C illustrate various types of fasteners for securing the cover to a container.
Figure 6B:
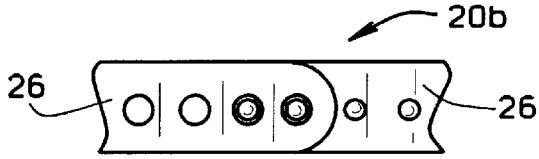
Figure 6C:
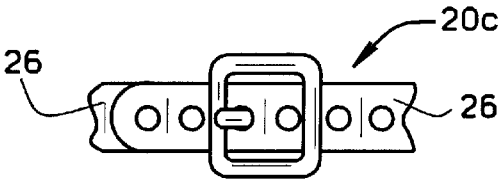

The cover is secured to sidewall S of a container C using a fastener means indicated generally 20. As shown in the drawings, material 12 is notched as indicated at 22 to form openings in the material about the respective handles H. Fastener means 20 includes a fastener 20*a*–20*c*, as respectively shown in FIGS. 6A–6C, extending across the base of the material, below each notch, to secure cover 10 in place. Fastener 20*a* is a velcro-type fastener, fastener 20*b* a snap-type fastener, and fastener 20*c* a buckle-type fastener. In each instance, the fastener includes a strap 26 one end of which is secured to the base of the material fabric. Each strap can comprise a short length of strap material sewn or otherwise secured to the fabric; or, as shown in FIG. 3, each strap may be a single piece of material which extends through the base 28 of the cover from the notch on one side of the material to the notch on the opposite side. Regardless of how formed, the fasteners tightly secure the cover to the container, while an opening is provided to allow someone to easily lift and move the container. Because the cover is tightly secured to the container, if the container is tipped over or inverted, the cover remains in place, preventing spillage of its contents.

Figure 7:
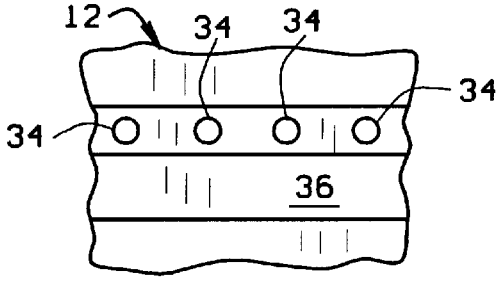
FIG. 7 illustrates an alternate closure arrangement for the cover to the zipper construction of FIGS. 3 and 4; and, FIG. 8 illustrates installation of the cover over a basket-type receptacle.

A closure means 30 extends across the portion of material 12 covering the mouth of the container when cover 10 is in place. The closure means, which is preferably a zipper 32, is openable to allow items to be placed in the container and secured therein when the zipper is closed. When the zipper is opened, the contents are readily discharged from the container by tipping or inverting it. For garbage cans and trash cans which are usually kept outdoors, the cover keeps the garbage or trash from the elements, as well as from animals. This makes storage and disposal of garbage and trash easier. In FIG. 7, an alternative closure includes a series of snap-type fittings 34 which extend across the portion of material 12 covering the mouth of the container when cover 10 is in place. A flap 36 can be attached to the cover adjacent the zipper or snap fittings to cover them and protect them from the elements, if desired.

What has been described is a container cover having widespread applications to various types of containers. The cover is readily attached to a container to allow both ease of handling of the container as well easy opening and closing so things can be placed in or discharged fro the container. The container cover is of a waterproof material that also is resistant to birds, rodents, and other vermin trying to chew or claw their way through the cover to get at what is in the container. The cover is easily installed and removed, and is easily cleaned for storage or before another use. The cover provides a low cost replacement for lost, damaged, or stolen lids, or as a low cost cover for containers which normally have no lid.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A cover for a can having a mouth, a circumferential sidewall one end of which defines the mouth, and horizontally extending handles attached to the sidewall a distance below the mouth comprising:

a flexible material fitting over the mouth of the can and extending down the sidewall thereof with a lower end of the cover reaching below the level of the handles, the lower end of the cover having openings therein to accommodate the handles;

fastener means at the lower end of the cover for securing the cover about the sidewall, the fastener means extending underneath the handles to secure the cover in place;

closure means extending across the portion of the material covering the mouth of the can when the cover is in place, the closure means being openable to allow items to be placed in the can and discharged therefrom, but the closure means, when closed, protecting the contents of the can from the elements and animals; and, handles attached to the material adjacent the closure means for lifting the can and the cover.

2. The cover of claim 1 wherein the closure means comprises a zipper and the handles are attached to the cover on opposite sides of the zipper.

3. The cover of claim 2 wherein the material comprises a waterproof fabric which is resistant to clawing and chewing.

4. The cover of claim 1 wherein said material is notched at the lower end thereof to form the openings in the material about the handles on the can, the fastener means including a fastener extending across the base of each notch, below the handles on the can, to secure the cover in place.

5. The cover of claim 4 wherein said fastener means is a hook and loop type fastener.

6. The cover of claim 4 wherein said fastener means is a snap-type fastener.

7. The cover of claim 4 wherein said fastener means is a buckle type fastener.

8. The cover of claim 1 wherein said closure means includes a plurality of snap-type fasteners and the handles are attached to the cover on opposite sides of the fasteners.

9. The cover of claim 1 further including a flap extending across the portion of the material covering the mouth of the can and covering the closure means.

10. The cover of claim 1 wherein said material is available in different colors.

11. The cover of claim 10 wherein said material is available with different patterns.

* * * * *